United States Patent [19]

Hargis

[11] 4,115,214

[45] Sep. 19, 1978

[54] FUSED BATH CELL LID HAVING CORROSION PROTECTION MEANS AND METHOD OF USING SAME

[75] Inventor: Robert L. Hargis, Palestine, Tex.

[73] Assignee: Aluminum Company of America, Pittsburgh, Pa.

[21] Appl. No.: 807,963

[22] Filed: Jun. 20, 1977

[51] Int. Cl.[2] ..... C25C 3/00

[52] U.S. Cl. ..... 204/64 R; 204/247

[58] Field of Search ..... 204/67, 68, 247, 274, 204/64 R

[56] References Cited

U.S. PATENT DOCUMENTS

| | | | |
|---|---|---|---|
| 2,401,821 | 6/1946 | Gardiner | 204/247 |
| 2,913,382 | 11/1959 | Everts | 204/247 |
| 3,463,721 | 8/1969 | Harris | 204/68 |
| 3,904,494 | 9/1975 | Jacobs et al. | 204/67 |

*Primary Examiner*—John H. Mack
*Assistant Examiner*—H. A. Feeley
*Attorney, Agent, or Firm*—Daniel A. Sullivan, Jr.

[57] ABSTRACT

A method for exhausting a substance through a port in a lid of a chamber, comprising conducting the substance through a tube within the port, which tube is more resistant to corrosion by the substance than is the port, and supporting the tube on a support means extending into the interior of the port, while cooling the support means to a temperature such that it too is more resistant to corrosion by the substance than is the port.

A cell lid having a metallic port, metallic protrusion means extending into the port, cooling means for extracting heat from the protrusion means, and a carbon or ceramic tube supported on the protrusion means.

5 Claims, 2 Drawing Figures

FUSED BATH CELL LID HAVING CORROSION PROTECTION MEANS AND METHOD OF USING SAME

BACKGROUND OF THE INVENTION

The present invention relates to structure and method for exhausting a corrosive substance from a chamber. More particularly, this invention relates to a method of exhausting chlorine from a molten salt electrolysis cell.

An example of such a cell is disclosed in U.S. Pat. No. 3,822,195 of Dell et al., issued July 2, 1974, for "Metal Production". This cell has a port 12 through which chlorine produced in the electrolysis can be exhausted from the cell. This chlorine is very hot, for example, 600° C, and can carry with it constituents spewed and/or evaporated from the molten salt bath in the cell. This mixture of hot chlorine and salt is highly corrosive, and during experimentation with the cell, the practice has developed to provide the interior of port 12 with a corrosion resistant tube lining, for example, a tube made of quartz. In practice, it has been found to be very difficult to retain the lining in place. Often, the experience has been that the tube will fall down into the molten salt bath. When the quartz falls out of place, the port itself quickly corrodes away, following which chlorine gas can escape out into the room containing the cell.

SUMMARY OF THE INVENTION

It is an object of the present invention to provide structure whereby the above outlined problems can be overcome. It is another object of the invention to provide corresponding process techniques by which the above outlined problems can be avoided in processes requiring the exhausting of a corrosive substance from a chamber.

These, as well as other objects which will become apparent in the discussion which follows, are achieved according to the present invention by (1) providing a method for exhausting a substance through a port in a lid of a chamber, including the steps of conducting the substance through a tube within the port, which tube is more resistant to corrosion by the substance than is the port, and supporting the tube on a support means extending into the interior of the port, while cooling the support means to a temperature such that it too is more resistant to corrosion by the substance than is the port; and (2) providing a cell lid having a metallic port, metallic protrusion means extending into the port, cooling means for extracting heat from the protrusion means and a carbon or ceramic tube supported on the protrusion means.

DESCRIPTION OF THE PREFERRED EMBODIMENTS

Figure 1:
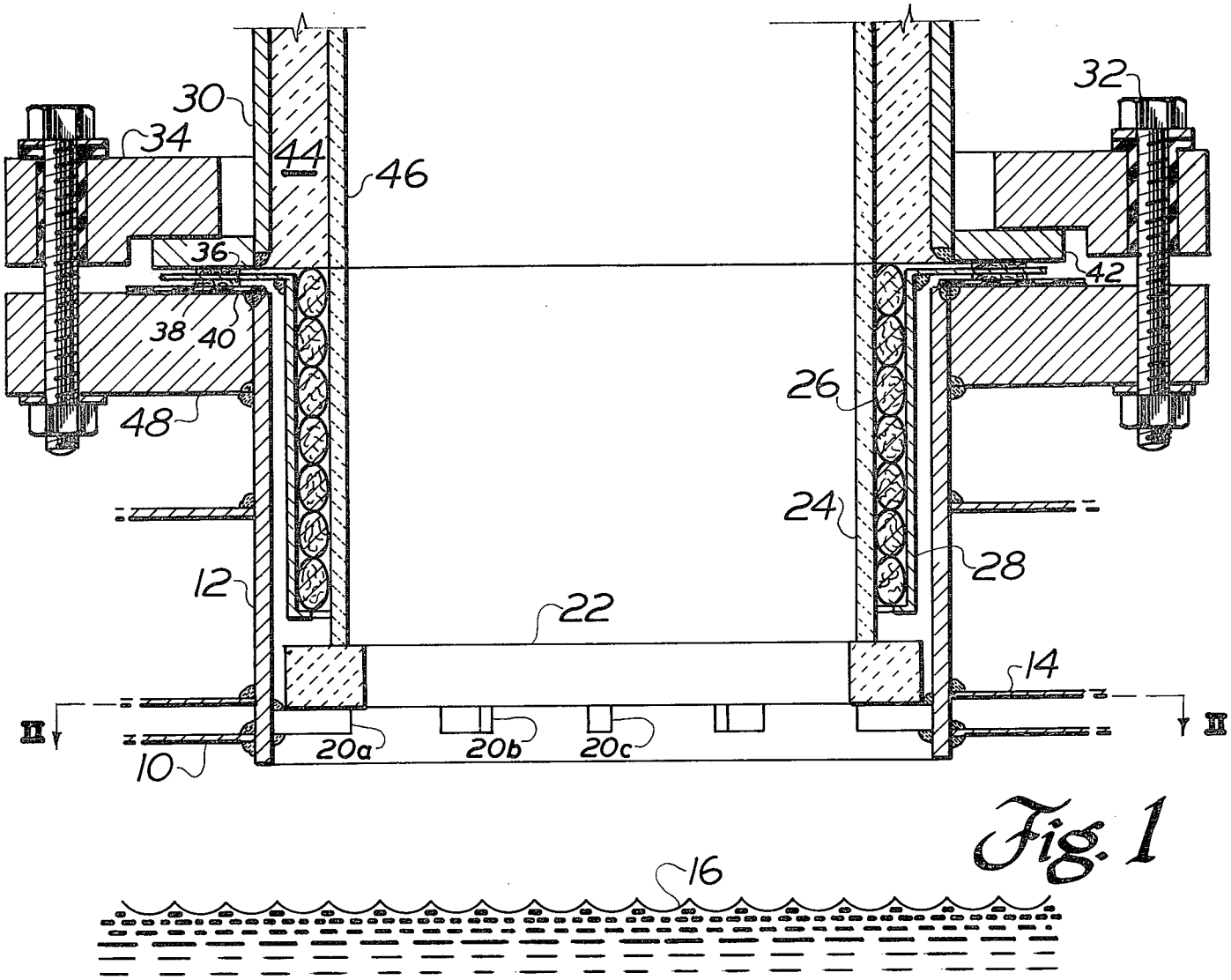
FIG. 1 is a cross-sectional view, taken on the line I—I of FIG. 2, of a portion of the lid according to the present invention.
Figure 2:
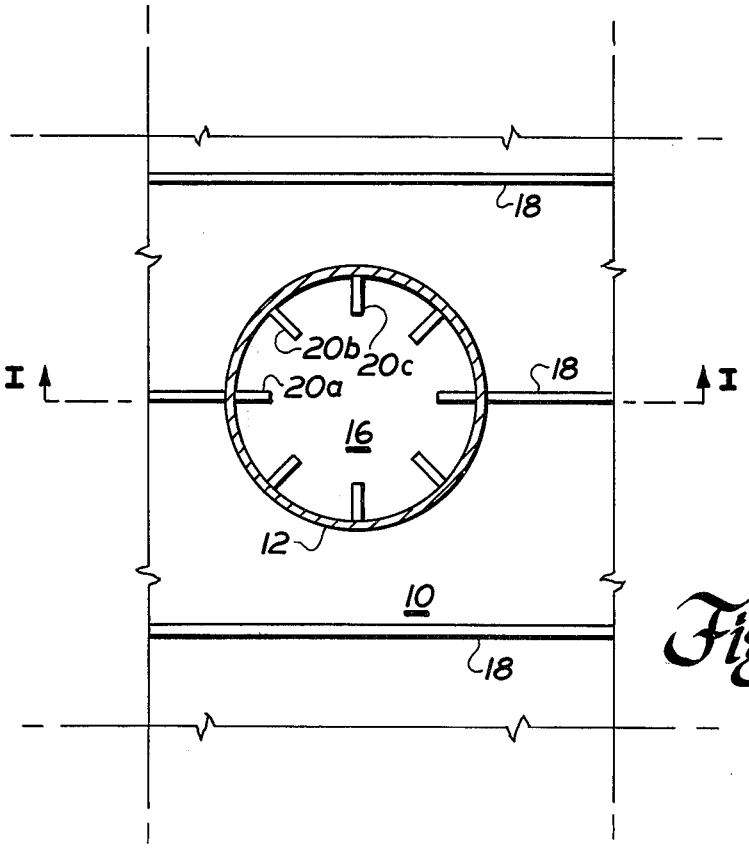
FIG. 2 is a cross-sectional view taken on the line II—II in FIG. 1, the scale being different from that in FIG. 1 as indicated by the diameter of port 12 in the two figures.

With reference to the FIGS. 1 and 2, the invention is illustrated in terms of use with a cell like that in the above-mentioned U.S. Pat. No. 3,822,195. With reference to FIG. 1 of that patent, lid 9 there corresponds to lid 10 here, while port 12 there corresponds to port 12 here. The cell partially illustrated here, however, has been modified with respect to that shown in U.S. Pat No. 3,822,195 to the extent that water cooling is provided on the top of lid 10 here, and the refractory roof 8 of that patent has been eliminated here. Thus, a cooling jacket 14 here covers the lid of the cell. And, lid 10 is exposed directly to chlorine and molten salt vapors and is made of a suitably chlorine-resistant metal, such as nickel or the alloy nominally containing 80% Ni, 15% Cr and 5% Fe, and sold under the trademark INCONEL.

While reference is made to the above-mentioned U.S. Pat. No. 3,822,195 for further exemplary details of the electrolysis in the cell, it is noted that the molten salt bath 16 may, for example, be at 715° C and have the following composition in weight-percent:

| | |
|---|---|
| NaCl | 51.0 |
| LiCl | 40.0 |
| $AlCl_3$ | 6.5 |
| $MgCl_2$ | 2.5 |

Water is circulated through jacket 14 to keep the undersurface of lid 10 at 120° F (about 50° C). Partitions 18 are for the purpose of assuring a uniform flow of water over all parts of the lid.

In practice, it is found that essentially no incrustation of bath on the undersurface of the lid is noted nor is the lid corroded by the chlorine. (The INCONEL metal of lid 10 does corrode in this environment when the undersurface temperature goes above 530° C.) It is noted that the sublimation temperature of $AlCl_3$ is certainly above the 120° F temperature of the lid undersurface, but the bath constituents reaching the lid exert a fluxing action to prevent $AlCl_3$ from depositing in solid form on the lid.

Referring now to the details of FIG. 1 specifically relating to the present invention, there is shown in port 12 nickel fingers 20*a*, 20*b*, 20*c*, etc. (collectively referred to with the numeral 20) welded to the interior of the metal port 12, which is likewise made of nickel, or INCONEL metal. These fingers support the graphite ring 22. Resting on the graphite ring is quartz tube 24. In practice, it is found that the nickel fingers 20 will corrode back to a point where their temperature is below the temperature at which they will corrode, the temperature gradient being, of course, due to the fingers being in contact with the water in jacket 14 through the metal wall of port 12 on one end and subjected to hot chlorine gas on the other end. There remains, however, enough of the fingers to support the graphite ring which will not corrode. While making the fingers 20 of metal is disadvantageous in that they corrode more easily, it is advantageous because of the ability to connect them strongly on the inner wall of port 12 by welding and because they then bear-up better to the tensile and shear portions of the bending stress on them than would be the case if they were ceramic or carbon. The quartz tube 24, graphite ring 22 and fingers 20 are not bonded to one another, but the interfaces between them and between port 12 and graphite ring 22 become wetted by spewed or condensing constituents from the bath and the resulting films of liquid and even solidified material prevent chlorine from getting up into the upper regions of port 12 where the port temperature can rise in the presence of hot chlorine to a corrosion dangerous level due to the longer distance away from the water in jacket 14. The outer surface of the quartz tube 24 is packed with ceramic fiber rope 26 maintained by packing gland 28.

A pipeline 30 leading to a chlorine and evaporated bath recovery operation (as described, for example, in U.S. Pat. No. 3,904,494, issued in the name of S. C. Jacobs et al. on Sept. 9, 1975, for "Effluent Gas Recycling and Recovery in Electrolytic Cells for Production of Aluminum from Aluminum Chloride") is connected via bolts 32, there being interposed a metal hold-down ring 34 and ceramic-fiber-based gaskets 36 and 38, the last being set on rubber or plastic electrical insulation ring 40 for added protection against electrical current leakage. The pipe 30 is provided with a flange 42, insulation 44, and a quartz lining tube 46. Ring 34 and flange 48 of port 12 provide the seats for bolts 32.

Explanatory of the broad concept of the present invention, the quartz tube 24 is more resistant to corrosion by the corrosive substance, e.g. chlorine, than is the port, considering the whole of the port, it being recognized that the lower end of the port is maintained at a low temperature by the water in jacket 14 to render that particular region non-corrosive. The portions of the fingers 20 that remain after their ends are corroded back to the critical temperature location are likewise more resistant to corrosion than is the port considered as a whole. The present invention is effective to maintain quartz tube 24 in place so that chlorine is prevented from getting into contact with the portions of port 12 remote from cooling jacket 14, so that there is no danger of chlorine corroding through the port wall and getting out into the environment.

It will be understood that the above description of the present invention is susceptible to various modifications, changes and adaptations, and the same are intended to be comprehended within the meaning and range of equivalents of the appended claims.

What is claimed is:

1. A method for exhausting a substance through a port in a lid of a chamber, comprising conducting the substance through a tube within the port, the substance being at a temperature such that it would corrode the port but for the containment of the substance within the tube, the tube being more resistant to corrosion bythe substance than is the port, supporting the tube on a support means extending into the interior of the port, the substance being able to corrode the support means at said temperature, and cooling at least a tube-supporting minimum of said support means sufficiently below said temperature such that said minimum remains uncorroded for supporting said tube.

2. A method as claimed in claim 1, wherein a metal chloride is being electrolyzed in a molten salt bath in the chamber, so that the substance comprises at least chlorine.

3. A method as claimed in claim 2, wherein the tube is a ceramic material, and the support means is a metallic material.

4. A method as claimed in claim 3, wherein there is interposed between the tube and the support means a graphite ring.

5. A lid having a metallic port, metallic protrusion means extending into the port, cooling means for extracting heat from the protrusion means and a tube supported on the protrusion means, wherein the tube is ceramic, and there is interposed between the tube and protrusion means a graphite ring.

* * * * *